US007389785B2

(12) United States Patent
Loudermilk et al.

(10) Patent No.: US 7,389,785 B2
(45) Date of Patent: Jun. 24, 2008

(54) STRUCTURAL SUPPORT ASSEMBLY

(76) Inventors: William A. Loudermilk, 1100 Burch Dr., Evansville, Vanderburgh County, IN (US) 47725; Richard D. Cook, 1100 Burch Dr., Evansville, Vanderburgh County, IN (US) 47725

( * ) Notice: Subject to any disclaimer, the term of this patent is extended or adjusted under 35 U.S.C. 154(b) by 467 days.

(21) Appl. No.: 11/107,537

(22) Filed: Apr. 15, 2005

(65) Prior Publication Data

US 2006/0231128 A1 Oct. 19, 2006

(51) Int. Cl.
*E04H 15/34* (2006.01)
*E04B 7/04* (2006.01)

(52) U.S. Cl. ..... 135/121; 135/144; 135/97; 135/120.3; 52/82; 52/92.1; 52/93.1; 52/646; 403/174; 403/217

(58) Field of Classification Search ..... 135/121–123, 135/120.3, 144–146, 87, 97, 159, 160; 403/174–175, 403/169, 217, 92; 52/82–83, 93.1–93.2, 52/643–646, 92.1–92.2, 655.1; 49/381
See application file for complete search history.

(56) References Cited

U.S. PATENT DOCUMENTS 2,723,673 A * 11/1955 Call ..... 135/140
4,347,690 A * 9/1982 Wallace, Jr. ..... 52/93.1
4,726,701 A * 2/1988 Thomas ..... 403/172
4,974,352 A * 12/1990 Shwu-Jen ..... 40/783
5,000,211 A * 3/1991 Speare et al. ..... 135/97
5,335,685 A * 8/1994 Dahulich ..... 135/156
5,526,614 A * 6/1996 Huang ..... 52/13
5,797,695 A * 8/1998 Prusmack ..... 403/170
6,338,226 B1 * 1/2002 Gauthier et al. ..... 52/63
6,345,638 B1 * 2/2002 Warner ..... 135/123
6,758,354 B2 * 7/2004 Carletti ..... 211/189
6,840,698 B2 * 1/2005 Cattaneo ..... 403/170
6,899,112 B2 * 5/2005 Tsai ..... 135/131

FOREIGN PATENT DOCUMENTS

WO WO 9946456 A1 * 9/1999

* cited by examiner

*Primary Examiner*—Winnie Yip
(74) *Attorney, Agent, or Firm*—Gary K. Price, Esq.

(57) ABSTRACT

A frame tent system having a plurality of upright columns, a plurality of eave members, and a plurality of rafters. The plurality of members are inter-connected by a system of novel eave weldments. The eave weldment is preferably a four-way connector unit interconnecting the frame members of the tent system at major points of connection to form the frame tent system. The eave weldment is formed of a weldment plate and an insert tube disposed perpendicular to the weldment plate. The frame members of the tent system each include a channel for releasably receiving ends of the eave weldment. In particular, the channel disposed in the rafter receives a first end of the weldment plate; the channel disposed in the upright column receives a second end of the weldment plate; the channel disposed in the eave members receive an end of the insert tube thereby forming the frame tent system.

24 Claims, 8 Drawing Sheets

STRUCTURAL SUPPORT ASSEMBLY

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates generally to the construction and assembly of temporary shelters such as frame tent systems, and more particularly relates to a structural support assembly used in the erection and support of the tent system.

2. Brief Description of Prior Art

Conventional tent systems, canopy frame structures, canvas shelters and the like of a readily assemblable and disassemblable nature such as utilized in the rental trade are commonly made up of cylindrical tubing and various types of junction elements or connectors. To assemble a given desired structure, it is conventional to join upright columns, eave members, and rafters with various types of junction elements or connectors. Fabric is then installed over the frame to enclose the tent structure.

The prior art in the field of tents and temporary shelters yields a variety of tent frame assemblies suitable for use in widely different situations. The circumstances of intended use largely determine the structural features to be included in or eliminated from the tent design. For example, tents employed by backpackers, should be of simple construction, preferably having lightweight components which may be connected without the need for tools or complicated hardware. In contrast to the foregoing, tents to be used at carnivals or exhibits are exposed to greater stresses over a longer period of time, but must nonetheless provide a stable shelter over a large area. Accordingly, frames for these tents generally feature heavier rigid columns linked together with eave members by reinforced connecting means. In the past, the assembly procedure for larger structures has been complicated and time-consuming.

There is a demand for a frame tent system that provides maximum shelter at a minimum weight, and further provides for simpler and quicker tent installation.

As will be seen from the subsequent description, the preferred embodiments of the present invention are improvements over existing structure support assemblies such as used in canvas shelters.

SUMMARY OF THE INVENTION

The principal feature and advantage of the present invention is an eave weldment of unique design for assembly and disassembly with the upright columns, eave members and rafters in forming the frame tent system. The columns, eave members and rafters include extruded channels for interconnecting with the designed eave weldments. The system is designed and configured with a maximized strength-to-weight ratio and can be readily fabricated by extrusion from high strength aluminum alloy or the like.

DESCRIPTION OF THE PREFERRED EMBODIMENTS

In accordance with the present invention, a structural support assembly is disclosed. The structural support assembly is directed to an improved structural support assembly designed and configured with a maximized strength-to-weight ratio that can be readily fabricated by extrusion from high strength aluminum alloy or the like, and provides for simpler and quicker tent installation. In particular, the present invention is an eave weldment of unique design for assembly and disassembly with the upright columns, eave members and rafters and forming the frame tent system. In the broadest context, the structural support assembly consists of components configured and correlated with respect to each other so as to attain the desired objective.

Figure 1:
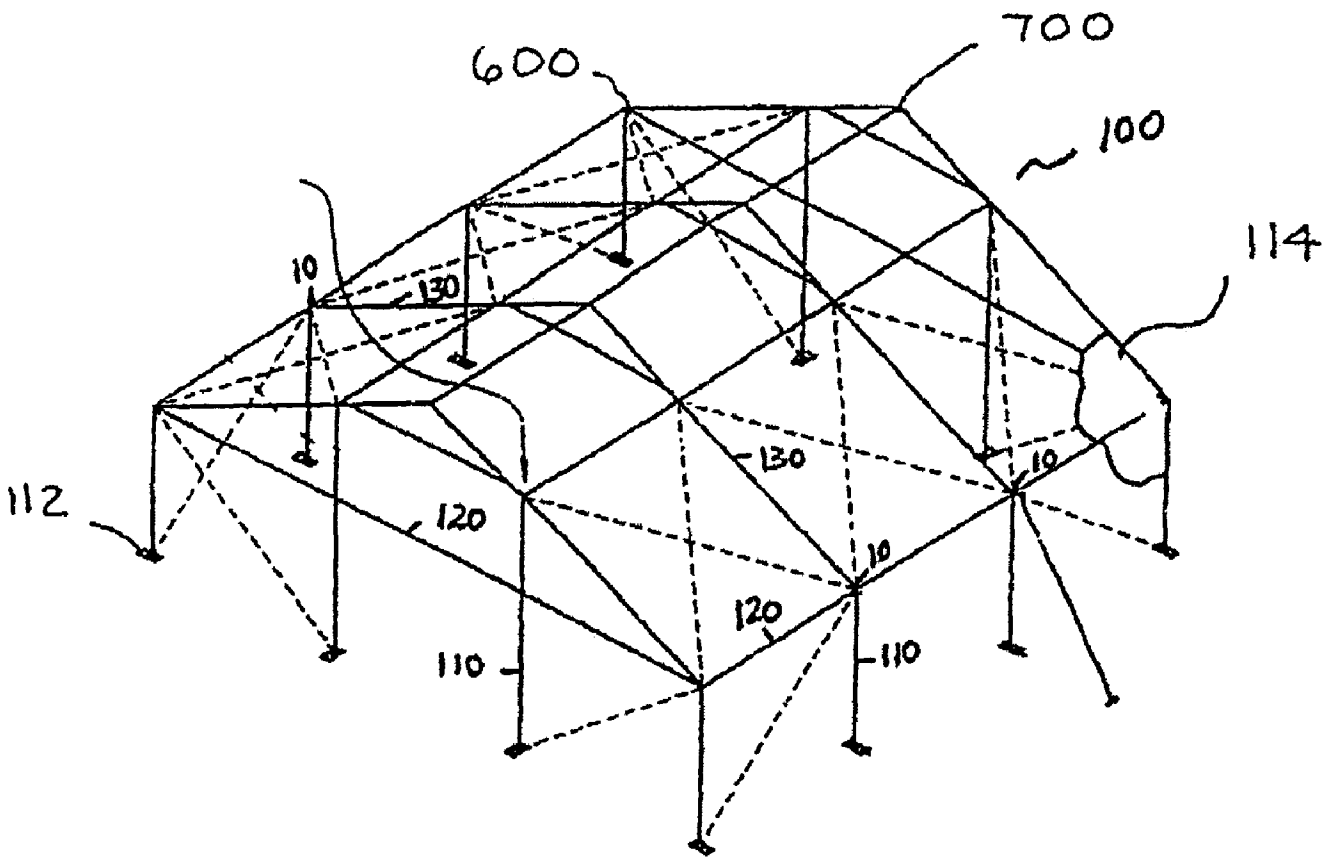
FIG. 1 is a perspective view of a frame tent system.

First referring to FIG. 1, and as known in the art, in accordance with the present invention, a frame tent system 100 is disclosed. Referring to FIG. 1, and as known in the art, the tent frame 100 is formed of a plurality of generally vertical upright columns 110, a plurality of generally horizontal eave members 120, and a plurality of rafters 130. The tent system 100 can have a cover 114 shown mostly cut away for clarity. The cover can be of any suitable material such as canvas or nylon for example. The tent system 100 can include connectors such as eave weldments 10, corner eave weldments 600 (see FIG. 6 for detail) and ridge weldments 700 (see FIG. 7 for detail).

Referring to the drawings, and in particular FIG. 1, the plurality of members 110, 120 and 130 are interconnected by a system of novel eave weldments 10, 600 and 700 into a large yet stable structure. Frame tent system 100 is most clearly defined by a consideration of the eave weldments 10 with frame members 110, 120 130 at major points of connection. As will be described here and below in greater detail, the eave weldments 10 unite an arrangement of frame members including the upright columns 110, eave members 120, and rafters 130. In this regard, the frame members 110, 120 and 130 each include a channel 50 for releasably receiving the eave weldment 10 and other weldments 600 and 700.

Figure 2:
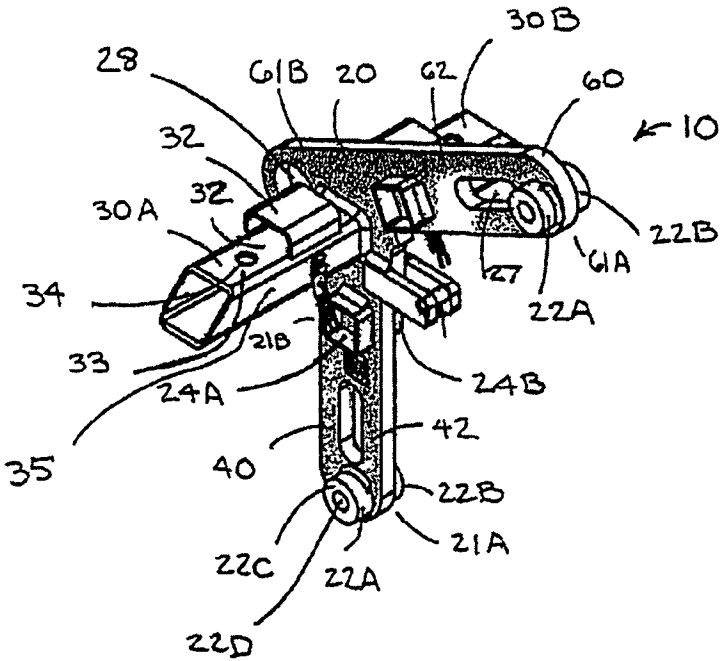
FIG. 2 is a perspective view of an eave weldment of the system of FIG. 1.

As shown in FIG. 2, the eave weldment 10 is preferably a four-way connector unit that ridgedly yet releasably interconnects the upright columns 110, the eave members 120, and the rafters 130 at common locations along the frame tent system 100, and further includes means for adjustably anchoring the system 100. The eave weldment 10 is formed of a weldment plate 20 (best shown in FIG. 3) and preferably a pair of insert tubes 30A, 30B attached to the sides of the weldment plate 20 in perpendicular relationship to first and second ends 40 and 60 that define the weldment plate 20.

Figure 3:
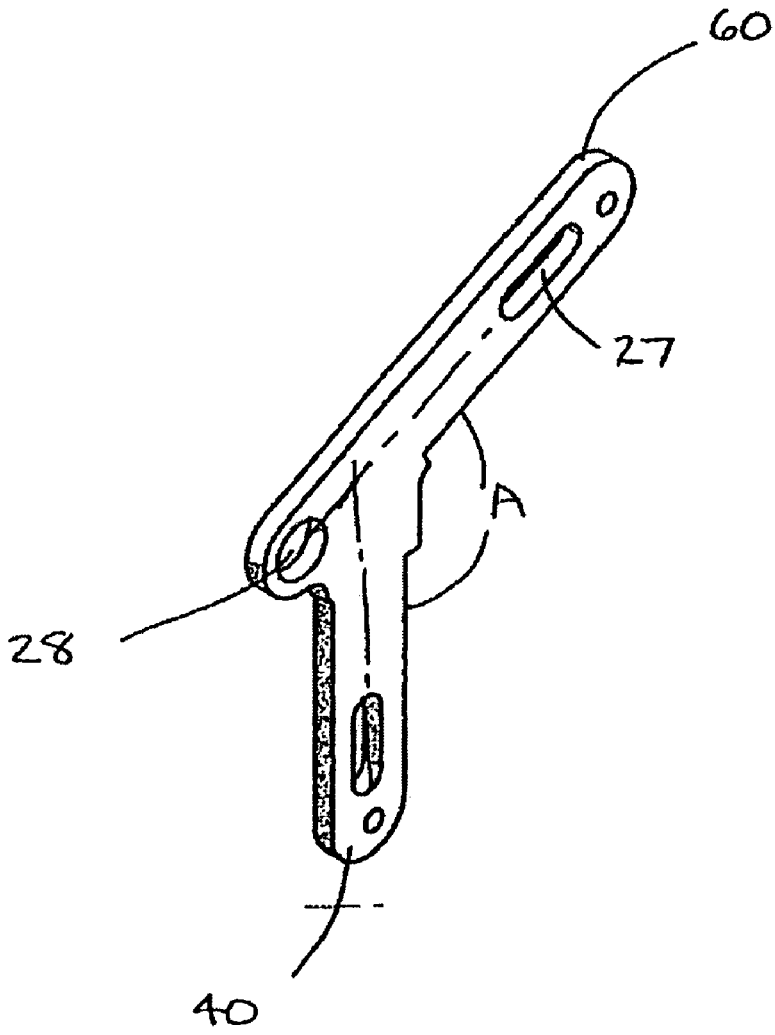
FIG. 3 is a perspective view of a weldment plate of the eave weldment of FIG. 2.

The weldment plate 20 can be steel plate having a thickness of ⅝ inch for example and having a generally L-shaped configuration comprising the first end 40 and the second end 60. In the preferred embodiment, the ends 40, 60 each having a pair of bushings 22A, 22B and a pair of spacers 24A, 24B projecting therefrom. As shown in FIG. 3, there is an angle "A" between ends 40 and 60. For example, angle "A" could be in the range of 100-135 degrees. The angle "A" determines the pitch of the roof of the frame tent system 100.

In particular, the first end 40 having one of the pair of bushings 22A projecting from a first side 42 of the end 40, and the second of the pair of bushings 22B projecting from a second side 44 of the end 40, such that the bushing 22A is serially aligned with bushing 22B. It being critical that the bushings 22A, 22B be disposed at a location 21A along the length of the first end 40, that location 21A at the approximate midway of the length of the first end 40. Likewise, the first end 40 having one of the pair of spacers 24A projecting from the first side 42 of the end 40, and the second of the pair of spacers 24B projecting from the second side 44 of the first end 40, such that the spacer 24A is serially aligned with spacer 24B. It being critical that the spacers 24A, 24B be disposed at a location 21B of the first end 40, that location 21B being at an approximate end 45 of the first end 40.

The second end 60 having one of the pair of bushings 22A projecting from a first side 62 of the end 60, and the second of the pair of bushings 22B projecting from a second side 64 of the end 60, such that the bushing 22A is serially aligned with bushing 22B. It being critical that the bushings 22A, 22B disposed at a location 61A along the length of the second end 60, that location 61A at the approximate midway of the length of the second end 60. Likewise, the second end 60 having one of the pair of spacers 24A projecting from the first side 62 of the end 60, and the second of the pair of spacers 24B projecting from the second side 64 of the end 60, such that the spacer 24A is serially aligned with spacer 24B. It being critical that the spacers 24A, 24B be disposed at a location 61B of the end 60, that location 61B being at an approximate end 65 of the second end 60.

The bushings 22A, 22B and spacers 24A, 24B are preferably of cylindrical configuration having flattened end surfaces 22C. The bushings 22A, 22B include central holes 22D that receive dowel pins that releasably connect members 110, 120, 130 to weldments 10, 600, 700. Spacers 24 can be tubular sections with flat ends.

As should be appreciated, the eave weldment 10 is symmetrically constructed and can include an insert tube 30A and 30B welded on opposite sides of the weldment plate 20. The insert tubes 30A, 30B generally in perpendicular relationship to the first and second ends 40, 60 that define the weldment plate 20. As such, only the insert tube 30A found on one side of the weldment plate 20 is primarily discussed herein. It should be understood that the insert tube 30B is identical to those described above, with the exception that the other insert tube 30B represents a mirror image of the insert tube 30A described.

The insert tube 30A includes a stop 32 disposed on a surface 33 of the insert tube 30A. It being critical that the stop 32 be disposed at a location 32A along the length of the insert tube 30A. A pair of pin holes 34 is further disposed through the surface 33 at approximate opposite ends of the insert tube 30.

Cable connected dowel pins 734 (see FIGS. 7 and 8) or similar fastening means for insertion into the pin hole 34 is preferably attached to a side surface 35 of the insert tube 30A.

The weldment plate 20 further includes plate apertures 27, and a tie down clearance 28 tie-down and for anchoring the system 100.

Assembly of the frame system of the present invention is similar to assembly of prior art tent frames. As shown in FIG. 1, the design of each eave weldment 10 of the present invention is to join a pair of eave members 120, and a rafter 130, and an upright column 110 at major points of connection to form the tent frame 100 shown.

An end of eave member 120 receives one of the ends of the insert tube 30A or 30B disposed concentrically therein, and is securely retained by one of the dowel pins inserted through the pin hole 34. In application, the stop 32 serve as locator stops so when an eave member 120 is installed over an end of the insert tube, one of the cable connected dowel pins can be inserted through the pin hole 34 and through a hole (not shown) of the eave member 120 in alignment with the pin hole 34, securing the eave member 120 in place.

An end of the rafter 130 receives the end 60 of the weldment plate 20. The bushings 22A, 22B and the spacers 24A, 24B of the end 60 of the weldment plate 20 are slidingly received within the channel 50 (as will be further described) of the rafter 130. When received, the bushings 22A, 22B and spacers 24A, 24B are in communication with the interior surface of the rafter 130 so that the end 60 of the weldment plate 20 is frictionally received and therefore releasably secured within the rafter 130.

An end of the upright column 110 receives the end 40 of the weldment plate 20. The bushings 22A, 22B and the spacers 24A, 24B of the end 40 of the weldment plate 20 are slidingly received within the channel 50 of the upright column 110. When received, the bushings 22A, 22B and spacers 24A, 24B are in communication with the interior surface of the column 110 so that the end 40 of the weldment plate 20 is frictionally received and therefore releasably secured within the upright column 110.

The frame members 110, 120, 130 of the system 100 each include a pair of ends (not shown) having openings that define the channel 50. The channel 50 adapted to receive the components of the eave weldment 10 namely, the insert tubes 30A, 30B, the first end 40 of the weldment plate 20 and the second end 60 of the weldment plate 20 as discussed above, such that the connecting members of the eave weldment 10 and the frame members 110, 120 and 130 are substantially in end-to-end relation to one another to form the frame tent system 100.

Figure 4:
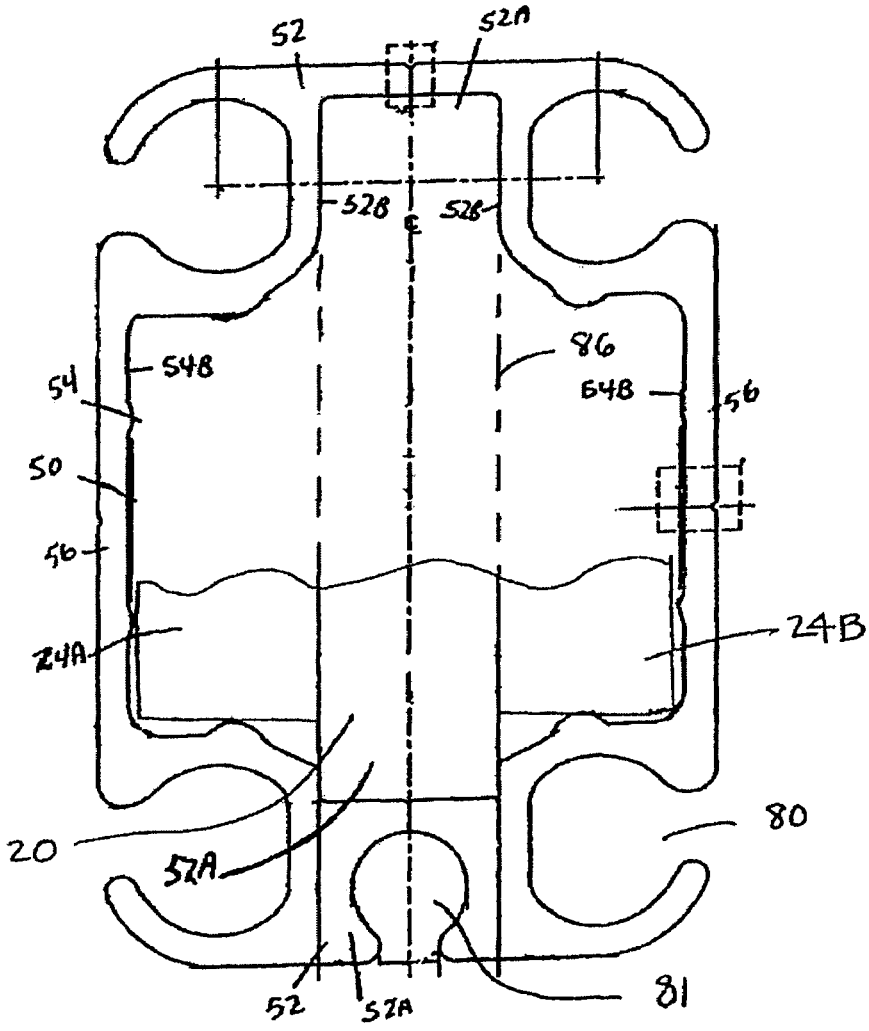
FIG. 4 is an end view of a structural member that receives the eave weldment of FIGS. 2 and 3.

Referring to FIG. 4, the design of the channel 50 of each of the frame members 110,120,130 is displayed, the channel 50 adapted to receive the eave weldment 10 as discussed above, such that the connecting members of the eave weldment 10 and the frame members 110, 120, and 130 are substantially in end-to-end relation to one another to form the frame tent system 100. The channel 50 can be a common cross section of each frame member 110, 120, 130 such that each frame member 110, 120, 130 can be formed by extrusion of aluminum or pultrusion of fiberglass for instance.

The channel 50 includes a pair of end sections 52 each defining a first inside width 52A that defines a generally rectangular opening (indicated by dashed lines 86, end section 52 and plate 20) that is less than a second inside width 54A disposed at a center of wider rectangular section 54 of the channel 50. In application, when the channel 50 receives the first end 40 of the weldment plate 20 for example, the first end 40 is received so that the bushings 22A, 22B and then the spacers 24A, 24B are received by the section 54 of the channel 50. When received, the flattened end surfaces 22C of the bushings 22A, 22B and spacers 24A, 24B are in frictional communication with the interior surfaces 54B of the section 54 so that the first end 40 of the weldment plate 20 is frictionally received therein. The spacers 24A, 24B and plate end 40 are shown, partially cut away, engaged in channel 50 in FIG. 4. The width 52A is generally the same as the width of the plate 20 and the width 54B is generally the same as the width of the plate 20 plus spacers 24A, 24B. The width 54B is further generally the same as the width of the insert tube 30A for example, designated "W1" on FIG. 2. It is understood that when the channel 50 receives the first end 40 of the weldment plate 20 for example as discussed above, the first end 40 is securely received within the pair of widths 52A. The weldment plate can be designed without bushings and spacers. As such, without inclusion of the bushings and spacers as discussed above, the channel 50 receives the ends of the weldment plate 20 securely within the pair of widths 52A.

When the channel 50 receives one of the insert tubes 30A for example, the insert tube 30A is received within the channel 50 until the stop 32 of the insert tube 30A abuts a side end 56 of the channel 50. The width "W1" of the insert tube 30A sized to be frictionally received within the width 54B of the channel 50. The insert tube 30A is then securely retained within the channel 50 by inserting a dowel pin through the pin hole 34 of the insert tube 30A and through a hole (not shown) of the frame member. As known in the art, the grooves 80, 81 in channel 50 can be used to secure the cover 114 to the outside of the frame tent system 100 or to secure material (not shown) to the inside of the frame tent system 100.

Figure 5A:
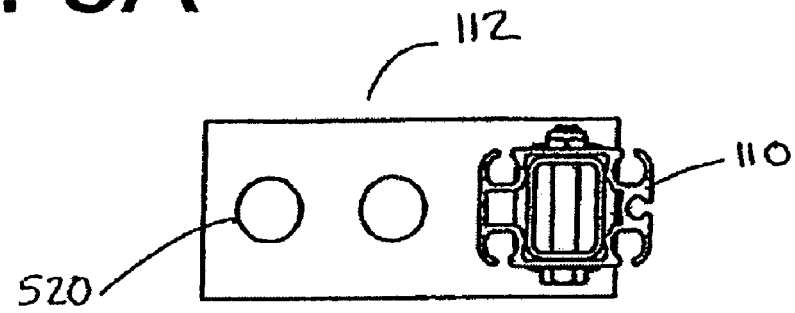
FIGS. 5A and 5B show details of a foot portion of the frame tent system.
Figure 5B:
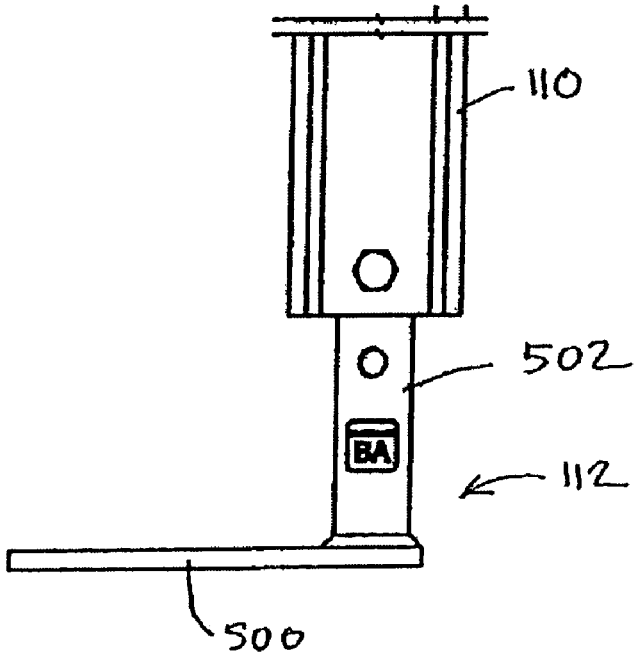

FIGS. 5A and 5B show the adjustable base plate 112. The adjustable plate 112 can include a foot 500 and shaft 502. The shaft 502 can insert into the channel 50 of the upright column 110. The shaft 502 can include a series of holes 506 and a fastener 510 such as a bolt, that can be removed to adjust the length of the upright column 110 and foot 500 to level the frame tent system 100 for example. The foot 500 can be a flat plate with openings 520 for a stake (not shown) for example.

Figure 6:
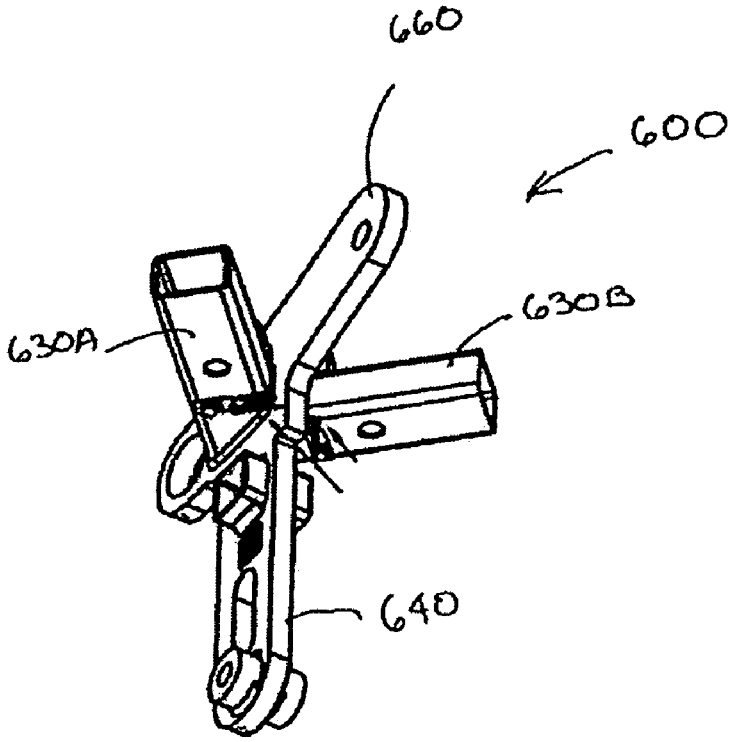
FIG. 6 is a perspective view of a corner eave weldment.

FIG. 6 shows a corner eave weldment 600 which can include a plate 620 having a first end 640 and a second end 660. Insert tubes 630A and 630B can be welded to the plate 620 at 45 degree angles to form a 90 degree corner of the eave of frame tent system 100.

Figure 7A:
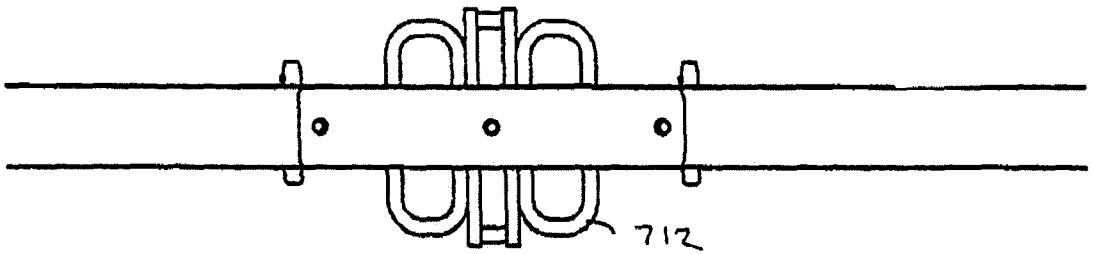
FIGS. 7A and 7B show ridge weldment details.
Figure 7B:
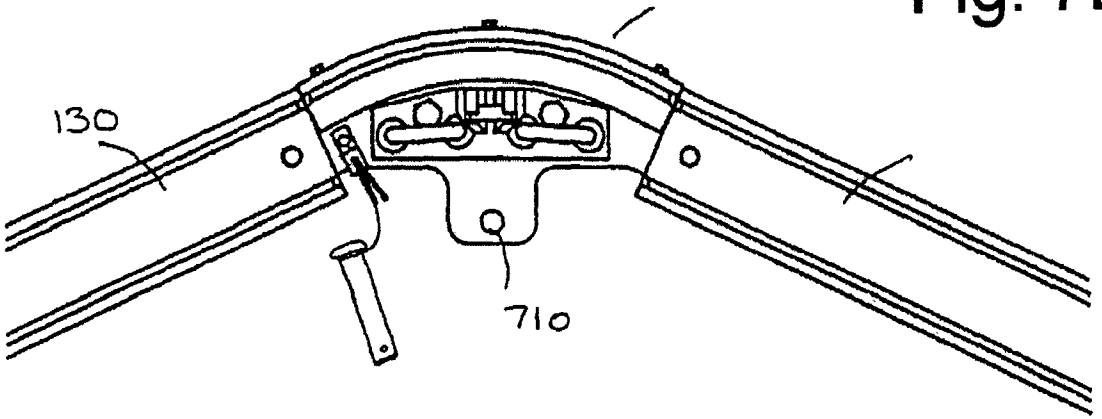

FIGS. 7A and 7B show the ridge weldment 700 connecting rafters 130 from opposite sides of the frame tent system 100. The ridge weldment 700 can include a cable attached dowel pin 734. Cable attached dowel pins 734 can be used on each weldment 10, 600, 700. The ridge weldment 700 can include hangers 710, 712 that allow a user to hang items (not shown) such as lights, for example, inside the frame tent system 100.

Figure 8B:
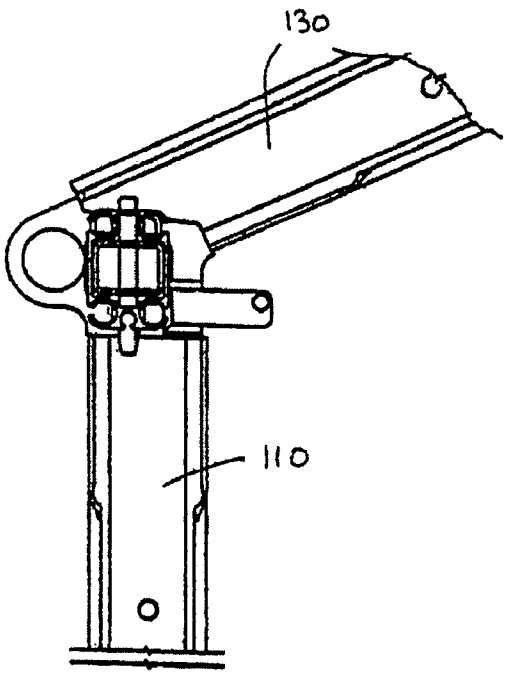
FIGS. 8A and 8B show details of a connection making up a portion of the frame tent system.
Figure 8A:
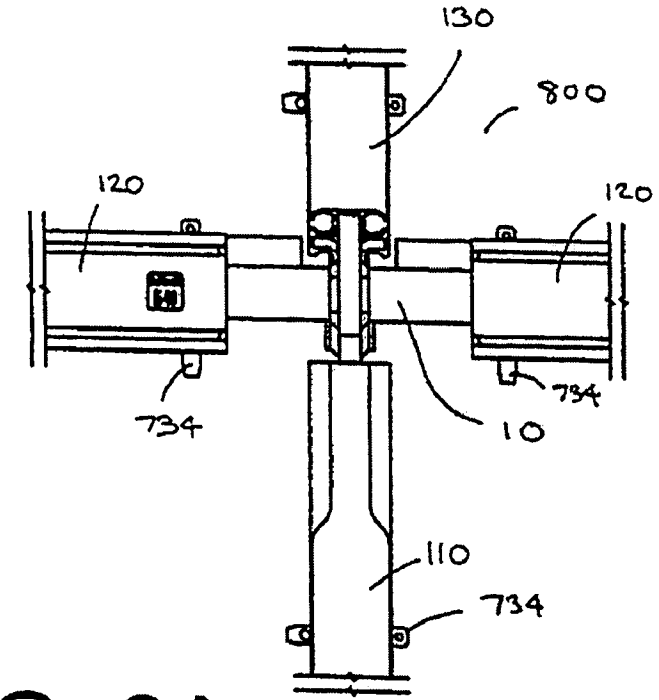

FIGS. 8A and 8B show a typical connection 800 between frame members 110, 120, and 130 shown particularly cut away for clarity. As can be seen, dowel pins 734 can be used to secure frame members 110, 120, 130 to the weldment 10 through the weight of the system 100 and could hold the weldment 10 in the upright column 110.

Although the description above contains many specificities, these should not be construed as limiting the scope of the invention but as merely providing illustrations of some of the presently preferred embodiments of this invention.

It will be obvious to those skilled in the art that modifications may be made to the embodiments described above without departing from the scope of the present invention. Thus the scope of the invention should be determined by the appended claims in the formal application and their legal equivalents, rather than by the examples given.

We claim:

1. A frame tent system comprising:

a plurality of upright columns, eave members, and rafters;

eave weldments for inter-connecting the columns, eave members and rafters;

wherein the eave weldment comprising a weldment plate;

wherein the weldment plate including a first end and a second end;

wherein the eave weldment further includes at least one insert tube, said insert tube including a stop disposed on a surface, and a pin hole disposed through the surface on opposite ends of the insert tube;

dowel pins attached to a side surface of the insert tube, said insert tube sized to fit frictionally in said eave member;

wherein said ends of the weldment plate sized to fit frictionally in said upright columns and said rafters.

2. The frame tent system as recited in claim 1, wherein each of the columns, eave members, and rafters include a common channel interior cross section for receiving said ends of the weldment plate, and receiving said at least one insert tube.

3. The frame tent system as recited in claim 1, wherein said first and second ends of the weldment plate each having a pair of bushings and a pair of spacers.

4. The frame tent system as recited in claim 1, wherein the at least one insert tube is generally perpendicular to said weldment plate.

5. The frame tent system as recited in claim 1, wherein the eave weldments are constructed of steel plate having a thickness of ⅝".

6. A frame tent system comprising:

a plurality of upright columns, eave members, and rafters;

eave weldments for inter-connecting the columns, eave members and rafters;

wherein the eave weldment includes a weldment plate and at least one insert tube;

wherein the weldment plate including a first end and a second end, said first and second end each having a pair of bushings and a pair of spacers;

wherein the insert tube including a pair of stops disposed on a surface, and a pin hole disposed through the surface on opposite ends of the insert tube;

dowel pins attached to a side surface of the insert tube;

wherein an end of the rafter receives the first end of the weldment plate;

wherein an end of the upright column receives the second end of the weldment plate; and wherein an end of the eave member receives the insert tube.

7. The frame tent system as recited in claim 6, wherein each of the columns, eave members, and rafters include a channel for receiving the ends of the weldment plate and the insert tube.

8. The frame tent system as recited in claim 7, wherein the bushings and the spacers of the first and second ends of the weldment plate are slidingly received within the channel of the upright column and the rafters so that flattened end surfaces of the bushings and spacers are in frictional communication with an interior surface of the channel.

9. The frame tent system as recited in claim 6, wherein the weldment plate is constructed of steel plate having a thickness of ⅝".

10. A frame tent system comprising:

a plurality of upright columns, eave members, and rafters, wherein each of the upright columns, eave members, and rafters include a common channel interior cross section;

eave weldments for inter-connecting the columns, eave member and rafters;

wherein the eave weldment includes a weldment plate and at least one insert tube;

wherein the weldment plate includes a first end and a second end, said first and second end each having a pair of bushings and a pair of spacers adapted to be frictionally received in said common channel interior cross section;

wherein said at least one insert tube is sized to fit frictionally in said common channel interior cross section such that said eave weldment forms a joint between at least one of each of said rafters, upright columns, and eave members.

11. The frame tent system as recited in claim 10, wherein holes pass through ends of said rafters, upright columns and eave members such that pins pass through said holes and into said bushings to lock said rafters, upright columns and eave members to said eave weldment.

12. The frame tent system as recited in claim 11, wherein said eave weldment includes a clearance receiving a tie down to secure said tent frame to the ground.

13. The frame tent system as recited in claim 11, wherein said eave weldment includes stops to position said eave members on said eave weldment.

14. The frame tent system as recited in claim 10, wherein said eave weldment includes a second insert tube, wherein said second insert tube is axially aligned with said at least one insert tube.

15. The frame tent system as recited in claim 10, wherein said at least one insert tube is generally perpendicular to said weldment plate.

16. A tent system comprising:

at least one upright column, at least one eave member, and at least one rafter each having a common channel section;

a weldment for inter-connecting the column, eave member and rafter;

wherein the weldment including a first end and a second end and at least one insert tube, said first end including at least two bushings frictionally received in said common channel section of said upright column and said second end including at least two bushings frictionally received in said common channel section of said rafter;

wherein said at least one insert tube is sized to fit frictionally with said common channel section of said at least one eave member to inter-connect said at least one rafter, upright column and eave member.

17. The tent system as recited in claim 16, including a foot section received in the common channel section of said upright column.

18. The tent system as recited in claim 16, wherein the common channel section runs an entire length of each of said upright column, said eave member and said rafter.

19. The tent system as recited in claim 18, wherein holes pass through ends of said rafter, upright column and eave member such that pins pass through said holes to lock said rafter, upright column and eave member to said weldment.

20. The tent system as recited in claim 18, wherein a first width in said common channel section defines a first rectangular opening and a second width in said common interior cross section defines a second rectangular opening.

21. The tent system as recited in claim 20, wherein the first width and the second width are sized to frictionally receive said weldment.

22. A tent system comprising:

at least one upright column, at least one eave member, and at least one rafter each having a common channel cross section;

a connector for inter-connecting the column, eave member, and rafter;

wherein the connector including a first end and a second end, said first end includes at least two bushings frictionally received in said common channel cross section of said upright column and said second end includes at least two bushings frictionally received in said common channel cross section of said rafter;

wherein a portion of said connector is sized to fit frictionally with said common channel cross section of said eave such that said connector inter-connects said at least one rafter, upright column and eave member and wherein the common channel cross section runs an entire length of the at least one eave, upright column and rafter members.

23. The tent system as recited in claim 22, wherein said at least one rafter is pinned to said connector with a dowel pin.

24. The tent system as recited in claim 22, wherein a base section including a foot plate fits into said common channel section of said upright column.

* * * * *